United States Patent [19]

Park et al.

[11] Patent Number: 4,893,113

[45] Date of Patent: Jan. 9, 1990

[54] GAS ALARM AND DETOXIFICATION HEATING SYSTEMS

[76] Inventors: Sea C. Park; In P. Park, both of 3836 Birchwood, Skokie, Ill. 60076

[21] Appl. No.: 150,389

[22] Filed: Jan. 29, 1988

[51] Int. Cl.[4] ..... G08B 17/10

[52] U.S. Cl. ..... 340/632; 73/23; 204/DIG. 6; 204/265; 165/11.1

[58] Field of Search ..... 340/632, 633, 634; 73/25, 26, 27 R; 200/61.03, DIG. 16; 126/101, 116 A; 165/11.1, 48.2; 204/265, 266, 129, 278, 431, DIG. 4, DIG. 6

[56] References Cited

U.S. PATENT DOCUMENTS

| | | | |
|---|---|---|---|
| 2,098,629 | 11/1937 | Knowlton | 204/DIG. 6 |
| 3,909,816 | 9/1975 | Teeters | 340/634 |
| 3,948,439 | 4/1976 | Heeger | 236/21 B |
| 4,123,700 | 10/1978 | La Conti et al. | 204/412 |
| 4,462,246 | 7/1984 | Advanti et al. | 340/632 |
| 4,726,888 | 2/1988 | McCambridge | 204/270 |
| 4,730,598 | 3/1988 | Swinton | 126/80 |

*Primary Examiner*—Joseph A. Orsino
*Assistant Examiner*—Jill D. Jackson
*Attorney, Agent, or Firm*—Birch, Stewart, Kolasch & Birch

[57] ABSTRACT

A single assembly of a water heating system for heating the water and air in a room, and an electrochemical reactor which activates a gas alarm for human safety upon detection of a predetermined dosage of gas, such as, for example, a fatal dose of a gas such as carbon monoxide, and which detoxifies the gas.

9 Claims, 9 Drawing Sheets

POWER SUPPLY LINE
111
113
112
107
108
123
122
118
117
124
119
102
101
103
116
121
106
104
109
105
178
110
114
120
115

GAS ALARM AND DETOXIFICATION HEATING SYSTEMS

CROSS REFERENCE TO RELATED APPLICATION

This application is related to application Ser. No. 133,924 entitled "CLEANER ASSEMBLY, HUMIDIFIER, GAS ALARM, AND DETOXIFICATION SYSTEM" filed Nov. 16, 1987 now U.S. Pat. No. 4,839,014, which is hereby incorporated by reference.

BACKGROUND OF THE INVENTION

The present invention relates to a multi-functional water and air heating system, gas alarm system, and gas detoxification system used indoors such as in a house, building, and factory. More particularly, the present invention relates to an assembly which includes a water heater and an electrochemical reactor which activates a gas alarm for human safety upon detection of a predetermined dosage of gas, such as, for example, a fatal dose of a gas such as carbon monoxide, and which detoxifies the gas.

Previously, many types of water heaters, gas alarms, and gas detoxification apparatuses have been separately developed. However, these home appliances suffer from a number of difficulties since a separate water heater, gas alarm device, and gas detoxification apparatus require separate purchases which are expensive and these appliances occupy a large amount of space in a given room.

SUMMARY OF THE INVENTION

Accordingly, it is an object of the present invention to provide a home appliance assembly having multiple functions, that is, water and air heating, use as a gas alarm, and use for gas detoxification for improving human environmental conditions.

Another object of the present invention is to provide a multi-functional appliance which comprises a heating system for water heating and air heating, and an electrochemical reactor for activating a gas alarm and detoxifying gas.

A further object of the present invention is to provide an apparatus which includes in its structure a device for producing and supplying oxygen by the electrolysis of water disposed therein.

Still another object of the present invention is to provide a home appliance assembly using a solar energy system so that the energy system can save electric power and eliminate the pollution from the electric power generator.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an assembly of an air and water heating structure for air and water heating and an electrochemical reactor which activates a gas alarm for human safety upon detection of a predetermined gas dosage, such as, for example, a fatal dose of a gas such as carbon monoxide, and detoxifies the gas.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
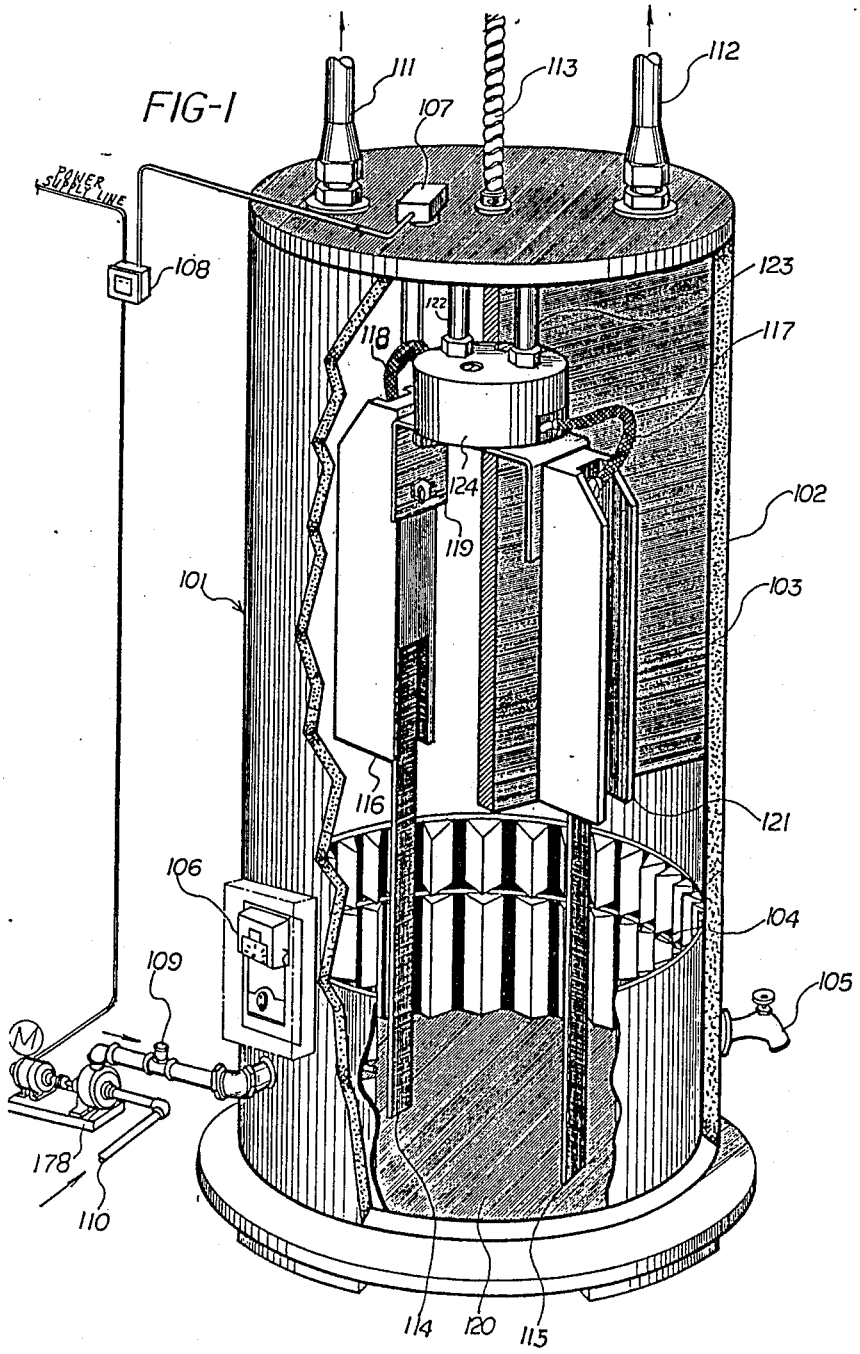
FIG. 1 is a perspective view of an electrochemical reactor of a multi-functional home appliance assembly of the present invention containing cut-away portions in order to illustrate the construction of a pair of electrodes of the present invention.
Figure 4:
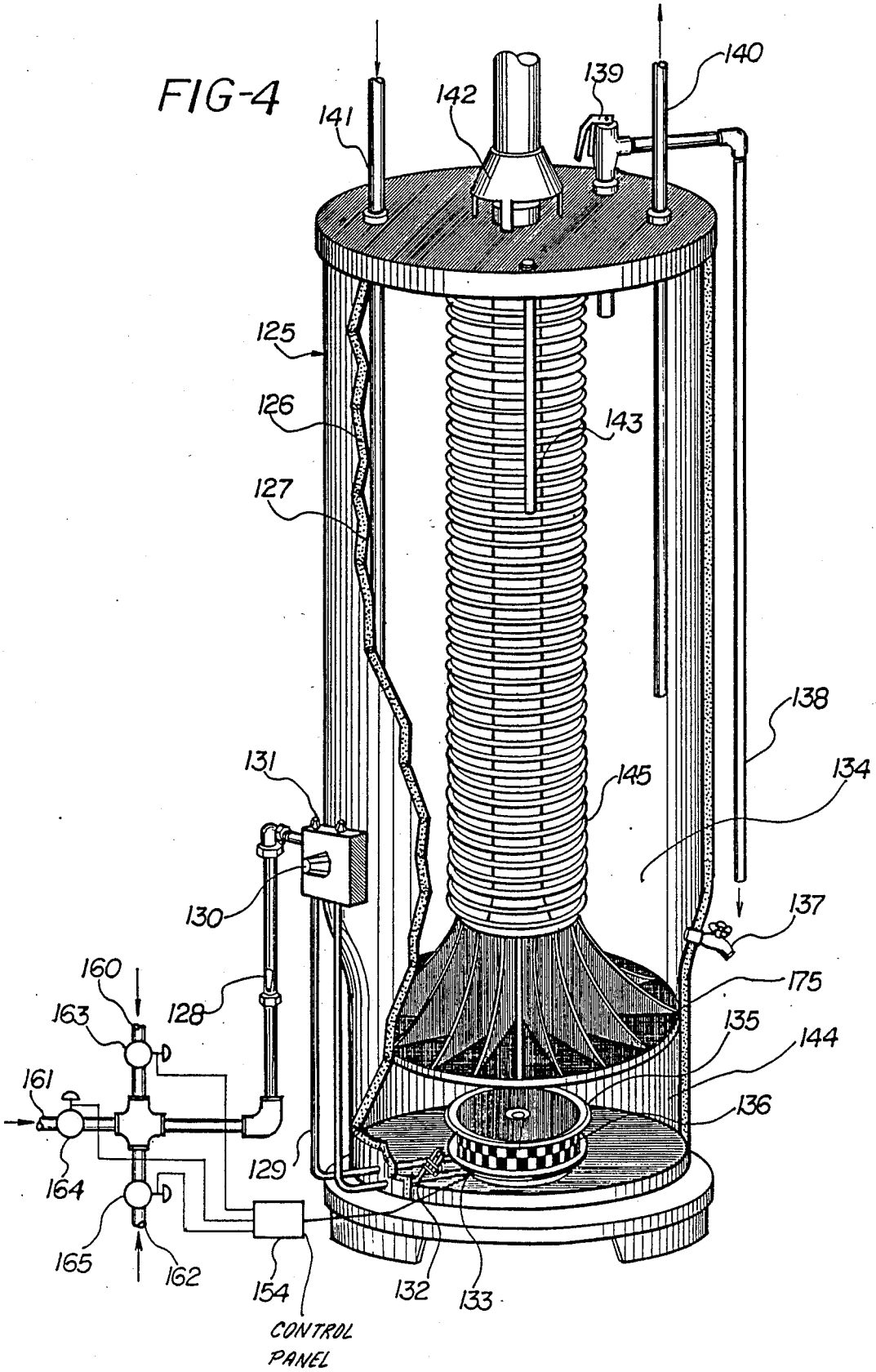
FIG. 4 is a perspective view of a water heater of the multi-functional home appliance assembly according to the present invention containing cut-away portions in order to illustrate the construction of a heat exchanging member of the present invention.
Figure 5:
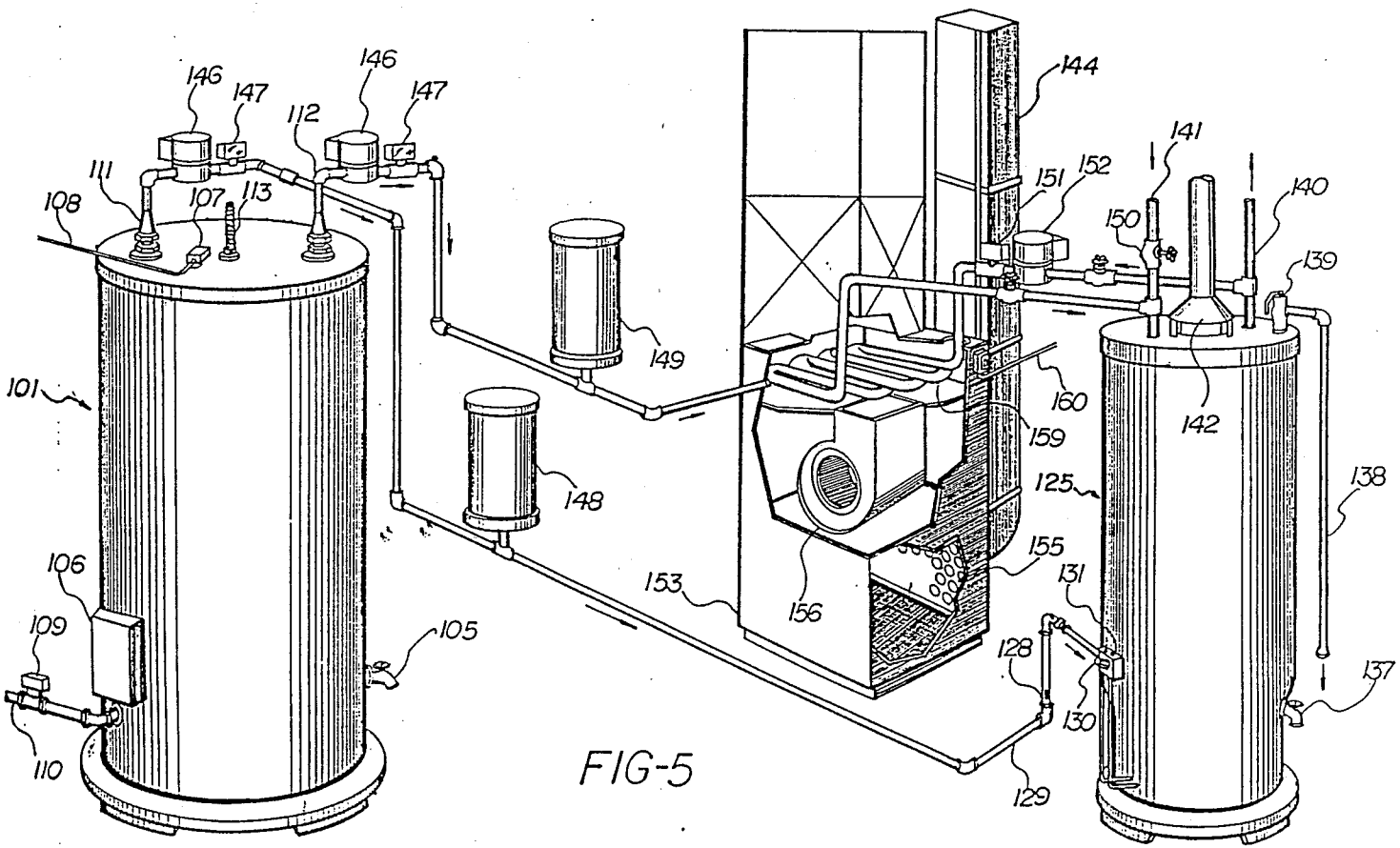
FIG. 5 is a perspective view of a multi-functional home appliance assembly of the present invention showing an arrangement of an electrochemical reactor and a water heater in a machine room for air nd water heating and for activating a gas alarm and detoxifying gas.

Referring now in detail to the drawings for the purpose of illustrating preferred embodiments of the present invention, the assembly apparatus as shown in FIGS. 1, 4, and 5 comprises an electrochemical reactor member 101 for activating a gas alarm and detoxifying gas and a water heater 125 for directly heating water stored therein and circulating the hot water delivered therefrom to indirectly heat air indoors.

Figure 3:
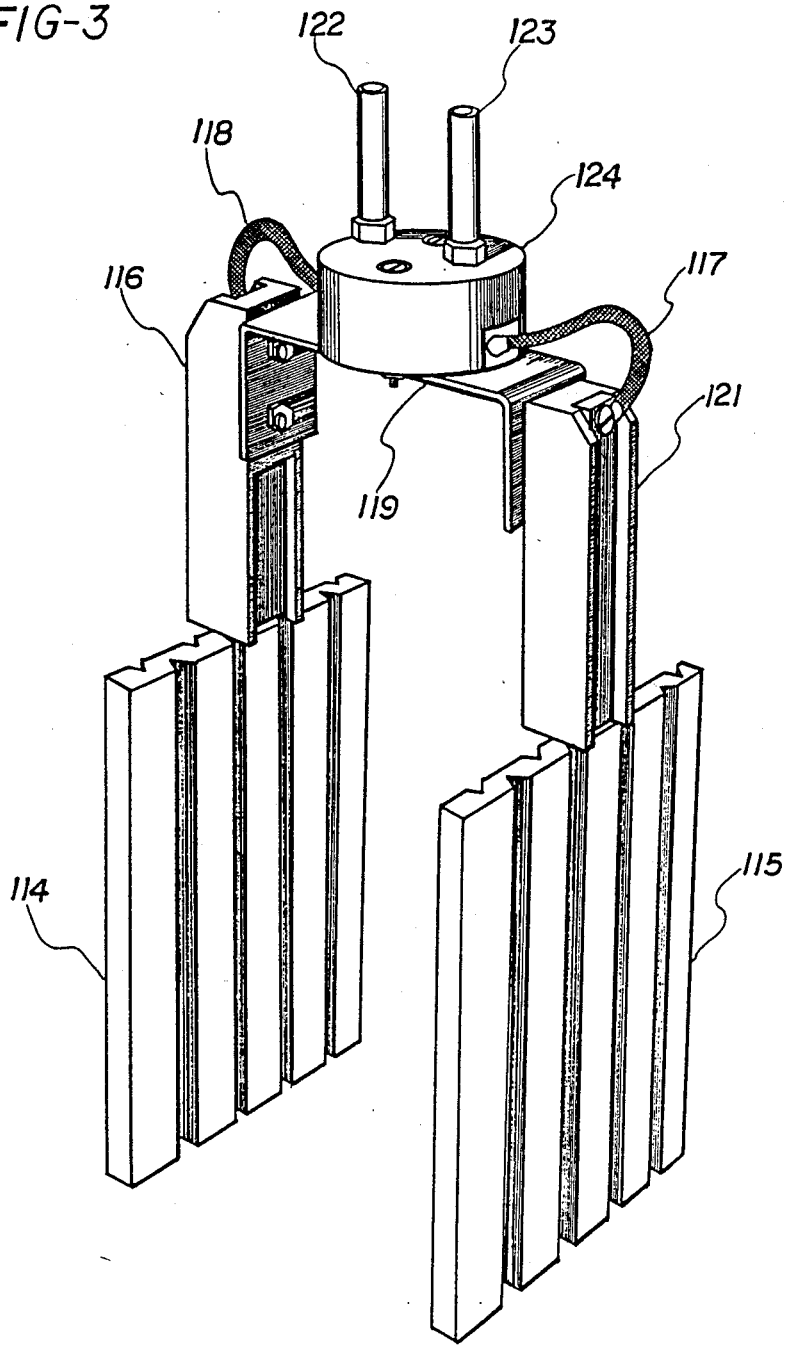
FIG. 3 is a perspective view illustrating another embodiment of the pair of electrodes of the electrochemical reactor of the multi-functional home appliance assembly according to the present invention.
Figure 7:
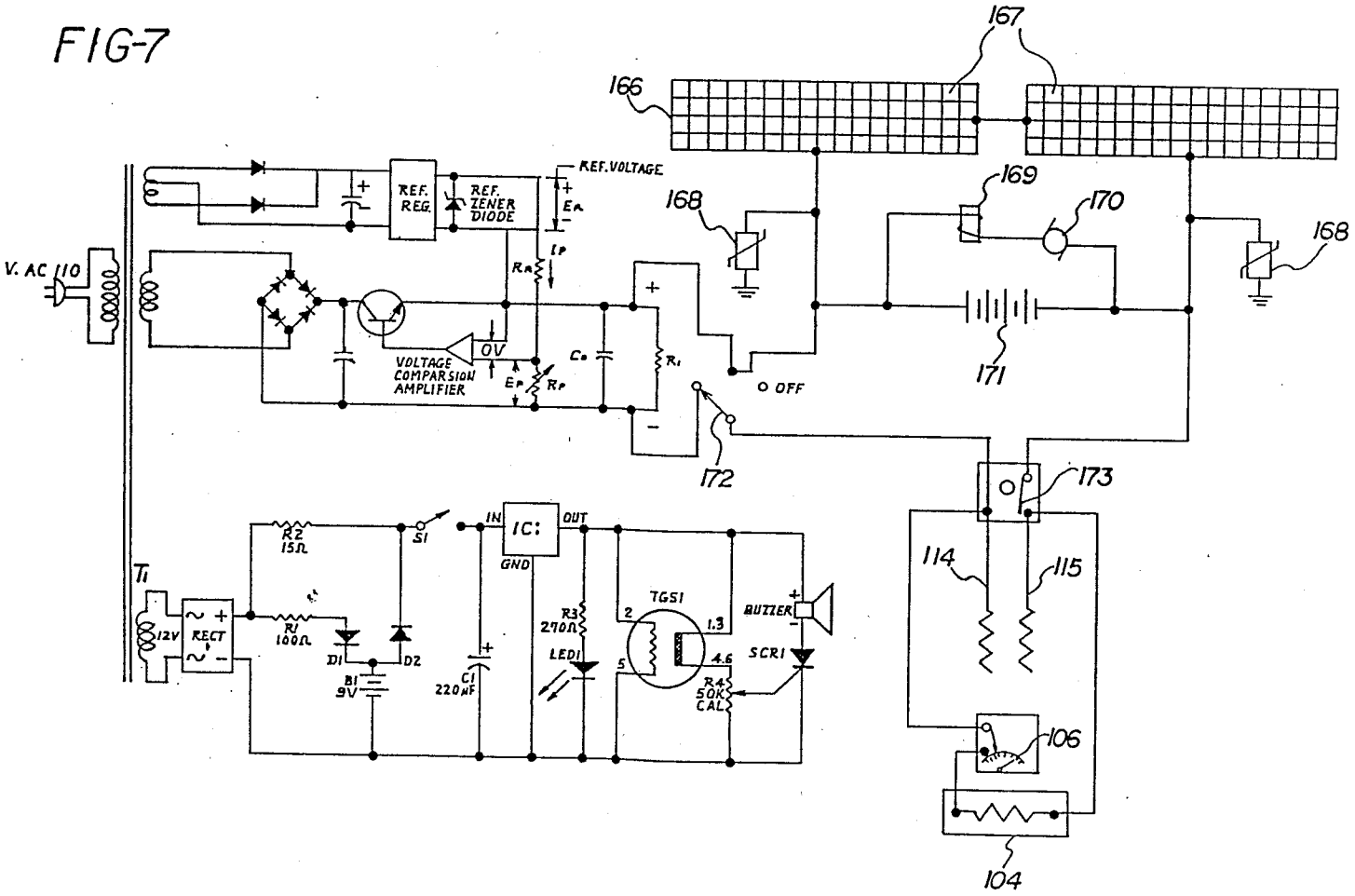
FIG. 7 is a diagrammic view showing an electrical system of an alarm device and solar energy and electric power systems of the assembly according to the present invention.
Figure 8:
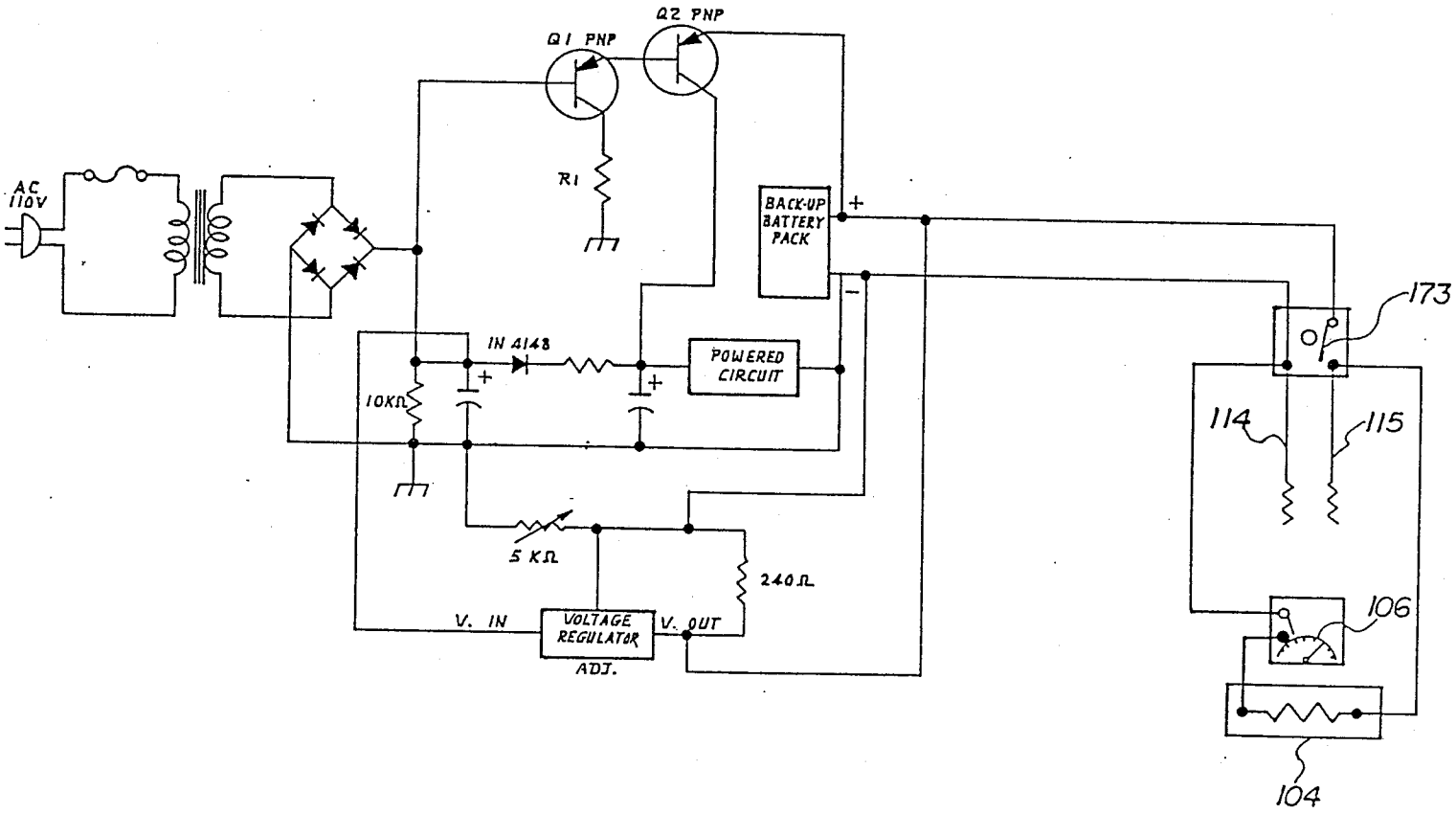
FIG. 8 is a diagrammic view showing an electric system of an electrochemical reactor according to the present invention.

As shown in FIGS. 1 and 3, the electrochemical reactor 101 is used as an electrolysis reactor for oxygen and hydrogen manufacturing, capable of using AC as well as DC current, solar energy, and a battery or a back up battery pack. The electrochemical reactor 101 contains a cathode 114, and anode 115, an oxygen indicator 183 (FIG. 6), and an electronic circuit (FIGS. 7 and 8).

Figure 2:
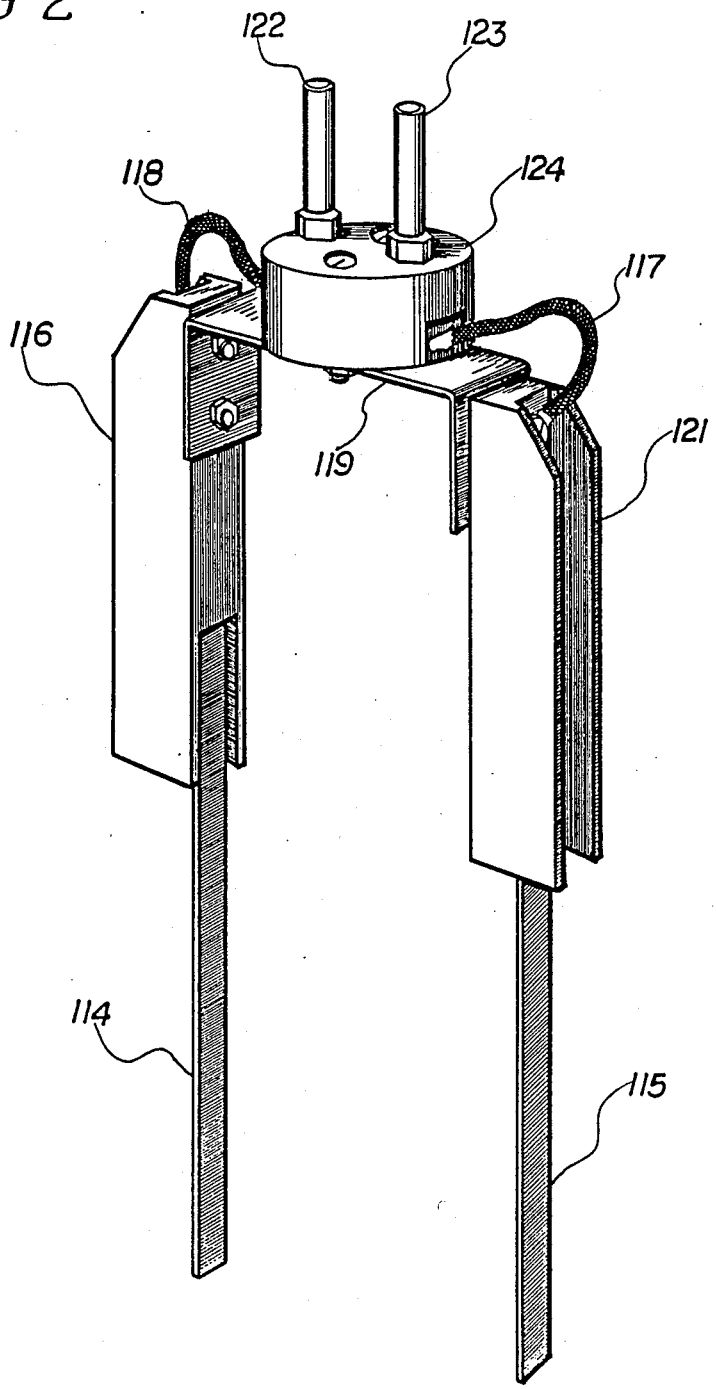
FIG. 2 is a perspective view of a pair of electrodes of a electrochemical reactor of the multi-functional home appliance assembly according to the present invention.

As shown in FIG. 2, the cathode 114 and anode 115 are disposed in ceramic conductive path members 116 and 121, respectively. A frame 119 attached to the ceramic conductive path members 116 and 121 contains a ceramic leading edge 124 disposed thereon. The ceramic leading edge 124 includes a cathode lead 122 connected to a cathode leader cable 118 which is connected to the cathode 114 disposed in the ceramic conductive path member 116. Also, the ceramic leading edge 124 includes an anode lead 123 connected to an anode leader cable 117 which is connected to the anode 115 disposed in the ceramic conductive path member 121.

Figure 6:
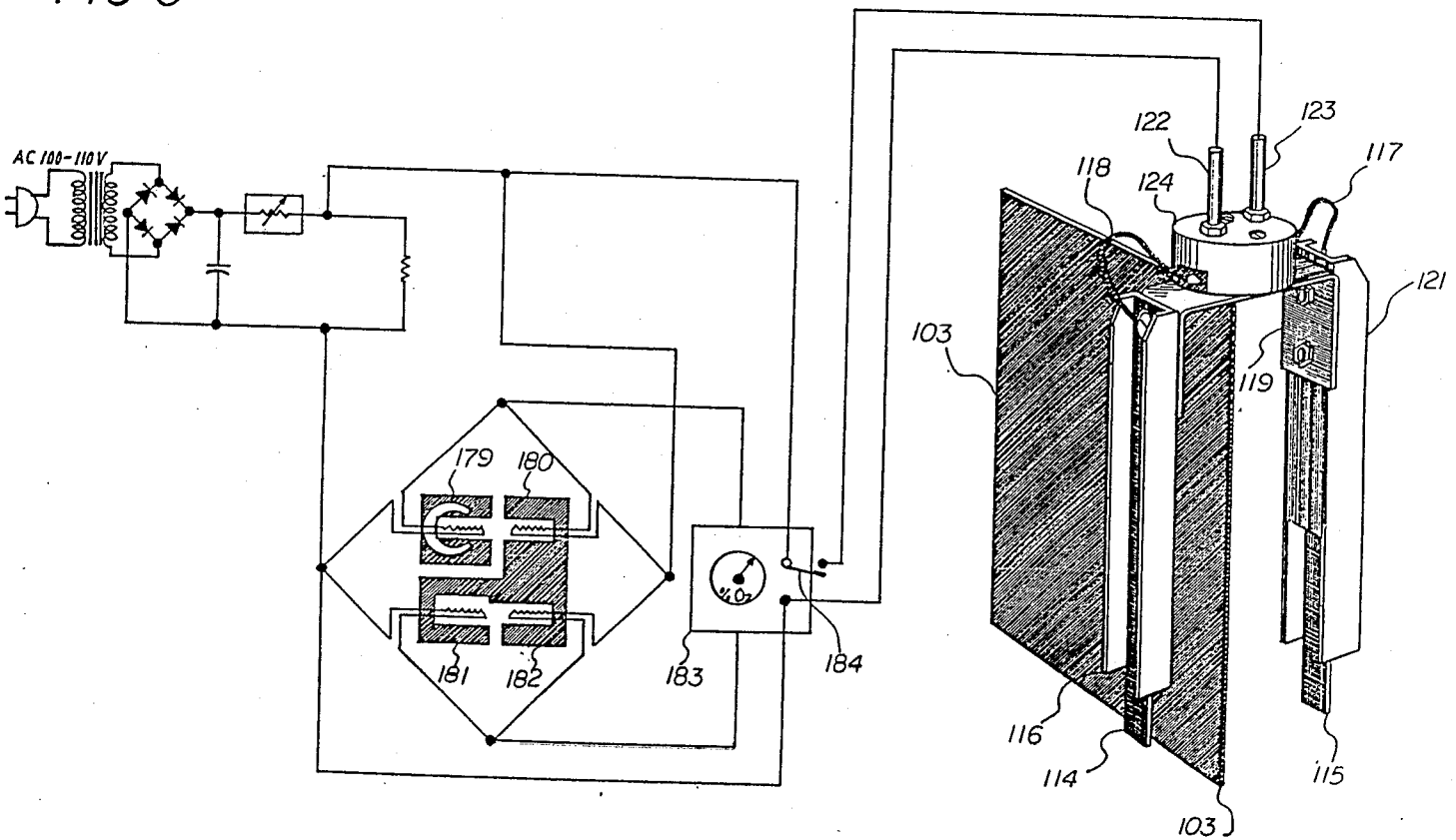
FIG. 6 is a diagrammic view showing a oxygen indicator associated with electrolysis components of the assembly according to the present invention.

A diaphragm 103 is disposed between the ceramic conductive path member 116 having the cathode 114 and the ceramic conductive path member 121 having the anode 115 (FIG. 6). An electric lead 113 connected to the cathode and anode leads 122 and 123 stands on a lid of the electrochemical reactor 101 (FIG. 1).

The electrochemical reactor 101 includes a heat sink 120 disposed in the lower portion thereof wherein the heat sink 120 is surrounded with a plurality of projecting heating members 104. The lid of the electrochemical reactor 101 is provided with a hydrogen outlet 111, an oxygen outlet 112 for exhausting hydrogen and oxygen manufactured by the electrolysis, respectively, and a water level controller 107 disposed on thereof. A motor M is connected to a motor controller 108 connected to the level controller 107. The motor M actuates a pump 178 causing the water to be introduced into the heat sink 120 through a water inlet pipe 110 with solenoid valve 109. The electrochemical reactor 101 having an insulation surface 102 is provided with a thermostat 106 for controlling the temperature of the water in the heat sink 120 and a water drain outlet 105 for draining the water therefrom.

Referring in detail to FIG. 3, there is illustrated an additional embodiment of electrodes of the electrochemical reactor 101 in accordance with the present invention. The electrodes include a large cathode 114', and a large anode 115', for use in a large space area such as an office room, conference room, or the like.

As shown in FIG. 6, the electrolysis system serves to control the supply of oxygen therethrough. That is, a on/off switch 184 is set at a predetermined oxygen percentage through an oxygen indicator 183 for the room. The electrolysis system operates to supply the oxygen and hydrogen. The operation of the electrolysis system is automatically stopped at the predetermined oxygen percentage. The oxygen indicator system comprises a sample measuring cell 179, a sample referencing cell 180, and pressure compensating cells 181 and 182 for measuring oxygen in the room.

The cathodes 114 and 114' may be made of platinum and the anodes 115 and 115' may be made of titanium oxide ($TiO_2$). In the electrolysis system, the electrolyte used may be water containing a small amount of sodium chloride, sulfuric acid, sodium hydroxide, and/or potassium hydroxide.

The reaction scheme of the electrolysis to produce oxygen and hydrogen is as follows:

$$4H_2O+4P^+ \rightarrow 2H_2+4OH^- \text{ (Cathode)}$$

$$4H_2O+4e^- \rightarrow O_2+2H_2O \text{ (Anode)}$$

wherein $P^+$ is a proton and $e^-$ is an electron.

The hydrogen and oxygen from the electrolysis system are exhausted through the hydrogen and oxygen outlets 111 and 112, respectively, into the room (FIG. 1).

As shown in FIGS. 7 and 8, the electronic circuits provide for a transfer from AC to DC by means of a transformer $T_1$. The transformer $T_1$ has 1.2 A and 110 V/120 V. Also, the electronic circuit includes a solar energy system, a back up battery pack, and a stand-by rechargeable battery. The solar energy system includes solar cell panels 166 containing a plurality of solar cell panel 167, surge protection variators 168, and a cut-out relay 169 for potentially charging a battery 171. In addition, the solar energy system includes a DC generator 170 powered by gas such as natural gas, the battery 171, and a switch 172. The solar cell panel 167 as a photovoltaic power cell is made of gallium arsenide or silicon. Thus the electric power converted from sunlight through the solar cells 166 is used as an energy source for the electrochemical reactor 101. If the solar energy system is not available for use during rainy or cloudy weather, the battery 171 or the DC generator 170 can be used. FIG. 8 illustrates a diagrammic view of the electronic circuit when the electrolysis operates with the battery 171. In FIG. 7, $R_1$ represents a 100 OHM and ½W resistor, $R_2$ represents a 15 OHM and 1 W resistor, $R_3$ represents a 270 OHM and ½W resistor, and $R_4$ represents a 50K OHM and linear potentiometer. $B_1$ represents Ni-Cd cells, $C_1$ is a 220 uF/16 V capacitor, $D_1$ and $D_2$ are 1 A/200 V silicon diodes, and Si is a SPST miniature switch. RECP represents a 50 V/1 A full wave rectifier, LED represents a red light emitting diode, and ICi is a 5 volt regulator. Buzz represents a piezo electric buzzer, SCRI a 200 V/0.8 A or 200 V/6 A silicon-controlled rectifier, and TGSI is a gas sensor.

As shown in FIG. 4, the water heater 125 containing water 134, heated by various gases, includes a combustion chamber 144 disposed in the lower portion thereof and a water tank 127 disposed in the upper portion thereof. The water tank 127 contains a fire conduit member 175 around which is wound a heat-exchanging screw member 145 disposed therealong for heating the water in the water tank 127. A hot water outlet 140 and cold water inlet 141 are communicated with the water tank 127. Also, a draft diverter 142 is connected to the fire conduit member 175. A relief valve 139 communicates with the water tank 127 and an extended pipe 138 stands on a lid of the water heater 125. An anticorrosion anode 143 is disposed in the water tank 127 and a drain valve 137 is disposed at the bottom of the water tank 127.

The combustion chamber 144 includes a burner 135 having a plurality of nozzles 136, and gas pipes 129 associated with an air shutter 132. The gas pipes 129 are connected to a natural gas pipe 160 having a natural gas valve 163, an oxygen pipe 161 having an oxygen valve 164, and a hydrogen pipe 162 having a hydrogen valve 165. These valves 163, 164, and 165 are solenoid valves and also are connected to a control panel 154 which is connected to a flame sensor 133. The gas pipe 129 is provided with a valve 128 and a thermostat 130 having knobs 131. The water heater 125 is provided with a steel surface containing an urethane insulator 126.

As shown in FIG. 5, the hydrogen and oxygen manufactured from the electrochemical reactor 101 are delivered to the water heater 125 and a furnace 153 through pumps 146 and a hydrogen expansion tank 148, motorized valves 147, and an oxygen expansion tank 149. A heating coil-pip unit 159 disposed on the furnace 153 connects to the cold water inlet 141 and hot water outlet 140 through valves 150 and 151, and a pump 152. A blower 156 disposed in the furnace 153 can deliver hot air filtered by a filter 155 into the room through a duct 144'.

Figure 9:
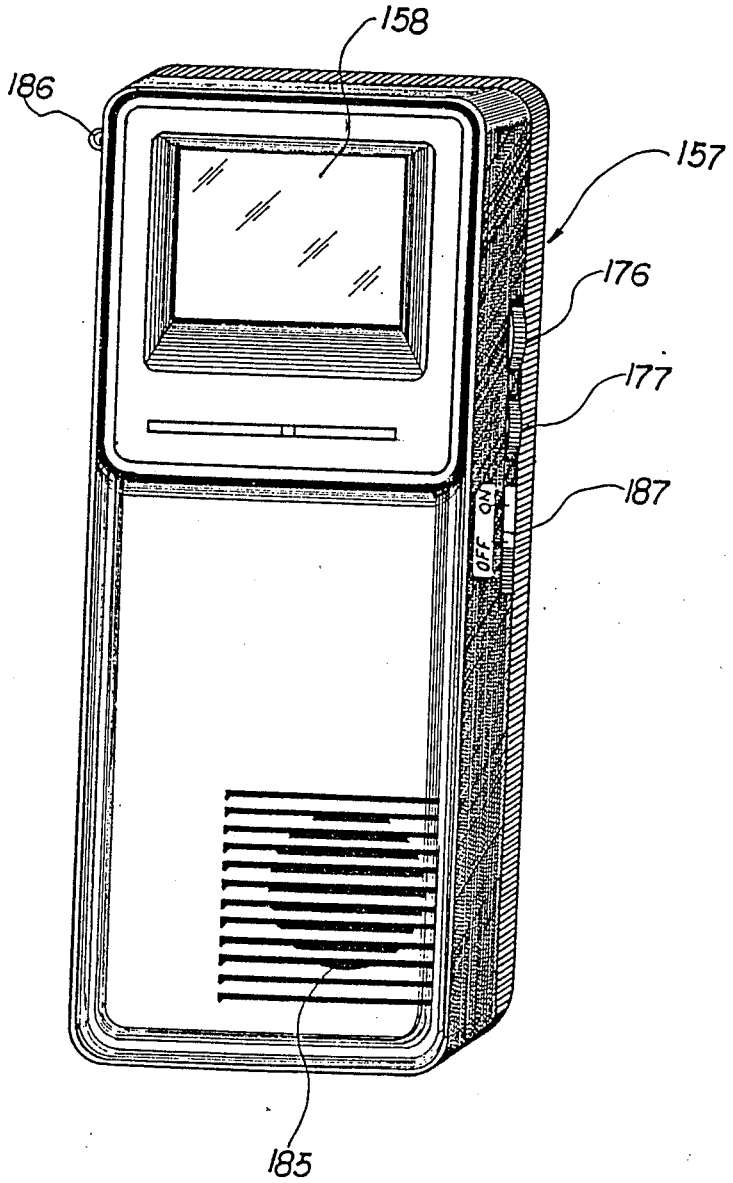
FIG. 9 is a perspective view illustrating another embodiment of an independent gas alarm device according to the present invention.

Referring in detail to FIG. 9 there is illustrated an additional embodiment of the present invention of a portable gas alarm device 157 in accordance with the present invention. The gas alarm device 157 includes a digital monitor 158 disposed in the upper portion thereof, a speaker 185 disposed in the lower portion thereof, a volume control 176, a select switch 177, a power switch 187 disposed on a side portion thereof, and an engaging member 186 which allows the device to be hung on a wall. The gas alarm device 157 is portable and is operated when the electrochemical reactor 101 does not work.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A gas monitoring and heating assembly which comprises an electrochemical reactor containing an anode and a cathode disposed therein for the electrolytic conversion of water into hydrogen and oxygen, means for recovering the oxygen from the electrochemical reactor and introducing it into the atmosphere, an oxygen room sensor operatively connected to the electrochemical reactor for controlling the generation of oxygen based upon the measurement of the oxygen content in the room, a water heater containing a burner, means for recovering the hydrogen from the electrochemical reactor and introducing it as fuel to the burner, cold water inlet means and hot water outlet means for introducing cold water to said water heater and recovering hot water from said water heater, said water being heated by indirect heat exchange with the heat generated from the burner, and heating means comprising a heating chamber which communicates with the atmosphere, heat exchange conduit means disposed in said heating chamber and connected to said cold water inlet means and hot water outlet means and blower means for blowing air across said heat exchange conduit means, whereby at least a portion of the hot water recovered from the hot water outlet means can be selectively introduced into the heat exchange unit means for heating the air from the blower means, said water with the heat removed therefrom being returned to the cold water inlet means, and a gas alarm operatively associated with the oxygen room sensor, said gas alarm being activated when the oxygen room sensor senses a reduction in the oxygen content of the room below a predetermined level.

2. The assembly of claim 1, wherein the water heater includes a water tank disposed in the upper portion thereof, a combustion chamber which houses the burner disposed in the lower portion thereof and an exhaust conduit extending from the combustion chamber through the water tank to exhaust the gases of combustion and indirectly heat the water in the water tank.

3. The assembly of claim 1, wherein the electrochemical reactor includes a solar energy system as a source of power, said solar energy system including solar cell panels which contain a plurality of solar cells, surge protection variators operatively connected thereto, and a cut-out relay operatively associated therewith.

4. The assembly of claim 3, wherein the solar cell is made of gallium arsenide or silicon.

5. The gas monitoring and heating assembly of claim 1 wherein inlet means are provided for adding supplemental natural gas and oxygen fuel to the burner.

6. The assembly of claim 5, wherein the cathode defines a first ceramic conductive path member, and the anode defines a first ceramic conductive path member, and the anode defines a second ceramic conductive path member, and a diaphragm is operatively disposed between said first and second ceramic conductive path members.

7. The assembly of claim 6, wherein the cathode disposed in the first ceramic conductive path member is connected to a cathode lead through a cathode leader cable.

8. The assembly of claim 6, wherein the anode disposed in the second ceramic conductive path member is connected to an anode lead through an anode leader cable.

9. The assembly of claim 6, wherein the oxygen room sensor includes an oxygen percentage meter operatively connected to a sample measuring cell, a sample referencing cell, and pressure compensating cells for measuring oxygen in the room.

* * * * *